US005941404A

United States Patent [19]

Charrette

[11] Patent Number: 5,941,404

[45] Date of Patent: Aug. 24, 1999

[54] TABBED THREADED CONTAINER CAP

[75] Inventor: Jamie J. Charrette, Roseville, Mich.

[73] Assignee: Denise A. Consiglio, Clinton Twp., Macomb County, Mich.

[21] Appl. No.: 09/083,625

[22] Filed: May 22, 1998

[51] Int. Cl.[6] ..... B65D 41/04

[52] U.S. Cl. ..... 215/305; 215/329; D9/443

[58] Field of Search ..... 215/296, 303, 215/305, 228, 329, 334, 331, 330, 356; 220/212, 288; D9/443, 452–454

[56] References Cited

U.S. PATENT DOCUMENTS

| | | | |
|---|---|---|---|
| 115,754 | 6/1871 | Mason . | |
| D. 351,793 | 10/1994 | Stoller | D9/443 |
| D. 374,623 | 10/1996 | Rafferty | D9/443 |
| 1,665,602 | 4/1928 | Netherland . | |
| 2,019,106 | 10/1935 | Vos . | |
| 2,078,743 | 4/1937 | Traum | 215/228 X |
| 2,248,011 | 7/1941 | Neuschaefer | 215/329 X |
| 2,549,225 | 4/1951 | Moy | 215/356 |
| 3,410,435 | 11/1968 | Kopczynski . | |
| 4,103,798 | 8/1978 | Moeller . | |
| 5,184,740 | 2/1993 | Mandrell II et al. . | |
| 5,213,225 | 5/1993 | King et al. . | |
| 5,431,305 | 7/1995 | Kaminski | D9/443 X |

FOREIGN PATENT DOCUMENTS

| | | | |
|---|---|---|---|
| 724566 | 4/1932 | France | 215/305 |
| 2609676 | 9/1977 | Germany | 215/305 |
| 288558 | 9/1931 | Italy | 215/305 |
| 676984 | 8/1952 | United Kingdom | 215/334 |

OTHER PUBLICATIONS

Wire Connector Product of It's A Snap Electrical Accessories, Hackettstown, NJ 07840 Undated.

*Primary Examiner*—Stephen K. Cronin
*Assistant Examiner*—Nathan Newhouse
*Attorney, Agent, or Firm*—Peter D. Keefe

[57] ABSTRACT

A threaded tabbed cap for being threadably interfaced with a container, particularly a plastic beverage container, wherein the tabs admit unidirectional assistance to a user in the direction of unthreading. A top wall is integrally formed with annular sidewall. At the interior side of the annular sidewall, threads are provided which have a predetermined structure to threadably engage the threads adjacent the opening of a predetermined container. A pair of tabs are integral with the exterior side of the annular sidewall and are located at opposing sides thereof. The tabs are of an asymmetric shape so as to provide aid to unthreading it from the container but not offer aid to threading it onto the container. In this regard, each tab has a forward face projecting radially from the exterior side of the annular sidewall and a rearward face tangential with an interface of the annular sidewall. It is preferred for the forward face to be concavely shaped, and for the rearward face to be substantially straight between the interface thereof with the annular sidewall and the apex. In the preferred embodiment, the tabbed cap is composed of a plastic material, wherein the tabs generally extend from the top wall to the cap opening in longitudinal relation to the cap.

2 Claims, 1 Drawing Sheet

TABBED THREADED CONTAINER CAP

BACKGROUND OF THE INVENTION

1. Field of the Invention

The present invention relates to threaded caps which are threadably engaged with threaded containers, most particularly plastic beverage containers. More particularly, the present invention relates to a threaded bottle cap having single faced tabs on opposing sides thereof for providing a finger/thumb abutment in the screw-off direction of rotation as an aid to removal of the cap from the container.

2. Description of the Prior Art

Threaded bottle caps which are threadably interfaced with the opening of a container have become very popular because the container can be opened without the necessity of a bottle opener and because the container may be resealed merely by threading the cap back onto the container. In the case of beverage containers, the threaded caps therefor have a relatively small diameter to properly fit onto the relatively small diameter container opening, wherein the opening diameter is small because of the container's rather small cross-sectioned neck. As a consequence, a user may have trouble unscrewing a factory closed container or one where the cap was screwed on tightly because the circumference of the cap is too small to get a good hand grip on it. Even when the cap is provided with longitudinal knurling, frequently a user will still find it hard to get a good enough grip to unscrew the cap from the container without considerable effort.

Therefore, it would be very advantageous if it could be possible to provide some sort of tabs on a threaded cap which would serve as an aid to unscrew it from a container. Further still, it would be even more advantageous if somehow a tabbed cap would serve as an aid to unthreading, but not serve to aid to threading, so that a person could not accidentally thread the cap back onto the container with too much force.

SUMMARY OF THE INVENTION

The present invention is a threaded tabbed cap for being threadably interfaced with a container, particularly a plastic beverage container, wherein the tabs admit unidirectional assistance to a user in the direction of unthreading.

The tabbed bottle cap according to the present invention is generally composed of a top wall and an integral annular sidewall. At the interior side of the annular sidewall, threads are provided which have a predetermined structure to threadably engage the threads adjacent the opening of a predetermined container.

A pair of tabs are integral with the exterior side of the annular sidewall and are located at opposing sides thereof. The tabs are of an asymmetric shape so as to provide aid to unthreading it from the container but not offer aid to threading it onto the container. In this regard, each tab has a forward face projecting radially from the exterior side of the annular sidewall and a rearward face tangential with an interface of the annular sidewall.

It is preferred for the forward face to be structured as a fingerhold having a concave shape, wherein the interface of the forward face with the annular sidewall is forward of the apex of the tab. It is further preferred for the rearward face to be substantially straight between the interface thereof with the annular sidewall and the apex.

In the preferred embodiment, the tabbed cap is composed of a plastic material, wherein the tabs generally extend from the top wall to the cap opening in longitudinal relation to the cap.

Accordingly, it is an object of the present invention to provide a tabbed threaded cap, wherein the tabs provide unidirectional twist assistance to a user for twisting off the cap from the container.

It is an additional object of the present invention to provide a tabbed threaded cap wherein the cap is functional, pleasing and integrates with conventional threaded cap convention with respect to threading onto conventional threaded containers.

These, and additional objects, advantages, features and benefits of the present invention will become apparent from the following specification.

DETAILED DESCRIPTION OF THE PREFERRED EMBODIMENT

Figure 1:
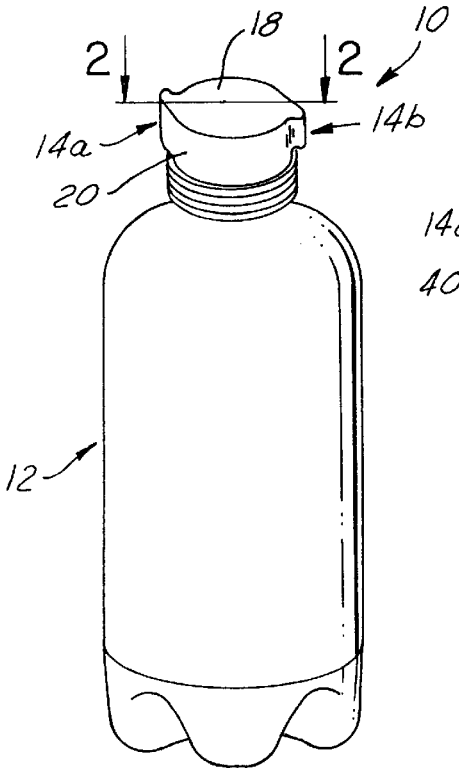
FIG. 1 is a perspective view of a beverage container having threaded thereonto the tabbed cap according to the present invention.
Figure 2:
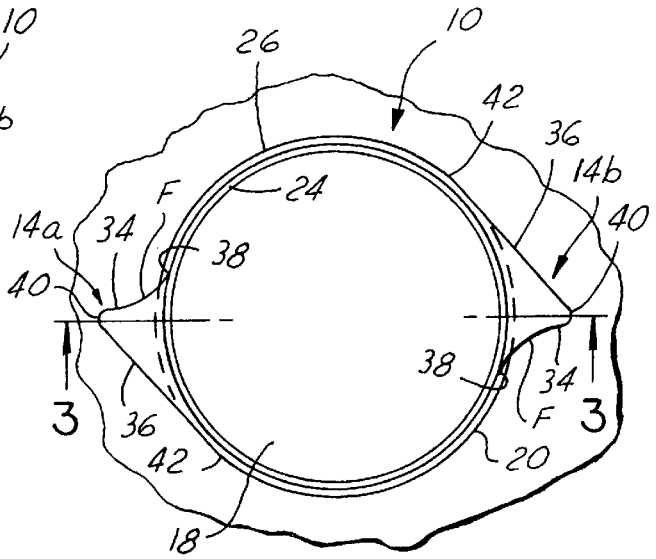
FIG. 2 is a top plan view taken along line 2—2 of FIG. 1.

Referring now to the drawing, FIG. 1 depicts a tabbed cap 10 according to the present invention threadably engaged onto a threaded container 12 in the form of a plastic beverage container. In operation, the tabbed cap 10 is unthreaded from the container 12 to thereby open the container and allow for dispensing of its contents; further, the tabbed cap may be again threaded onto the container to thereby reseal the container. In order to assist a user to effect unthreading of the tabbed cap 10 with respect to the container, tabs 14*a,* 14*b* are provided on opposing locations of the annular sidewall 20 thereof. The tabs 14*a,* 14*b* are asymmetric, whereby a user has a fingerhold F in only one direction of threading: the rotational direction that unthreads the tabbed cap 10 from the container 12.

The tabbed cap 10 includes generally conventional structural and functional aspects, in that it has a top wall 18, integral annular sidewall 20 and threads 22 on the interior side 24 of the annular sidewall. The tabbed cap 10 further includes novel structural and functional aspects including the aforementioned pair of mutually opposed tabs 14*a,* 14*b* located on the exterior side 26 of the annular sidewall 20. As shown at FIG. 3, it is preferred for the tabs 14*a,* 14*b* to extend coterminously in longitudinal relation with the annular sidewall 20 from the top wall 18 to the cap opening 28.

It is preferred for the tabbed cap 10 to be composed of a plastic material, particularly those plastics presently used for conventional plastic threaded caps for threaded beverage containers. It is further preferred for the tabs 14*a,* 14*b* to be formed integrally with the annular sidewall 20, such as for example the top wall 18, annular sidewall and tabs being formed as a single piece via an injection molding operation.

Figure 4:
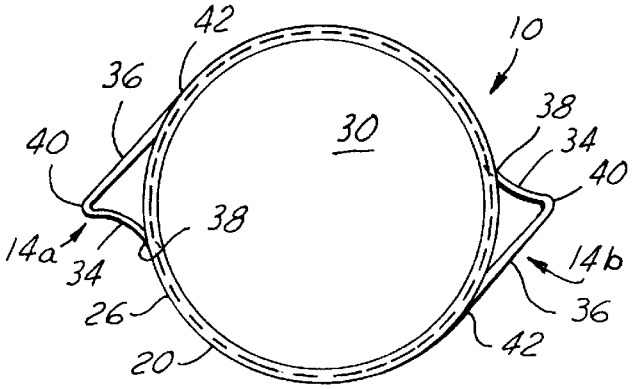
FIG. 4 is a sectional view taken along line 4—4 of FIG. 3.
Figure 3:
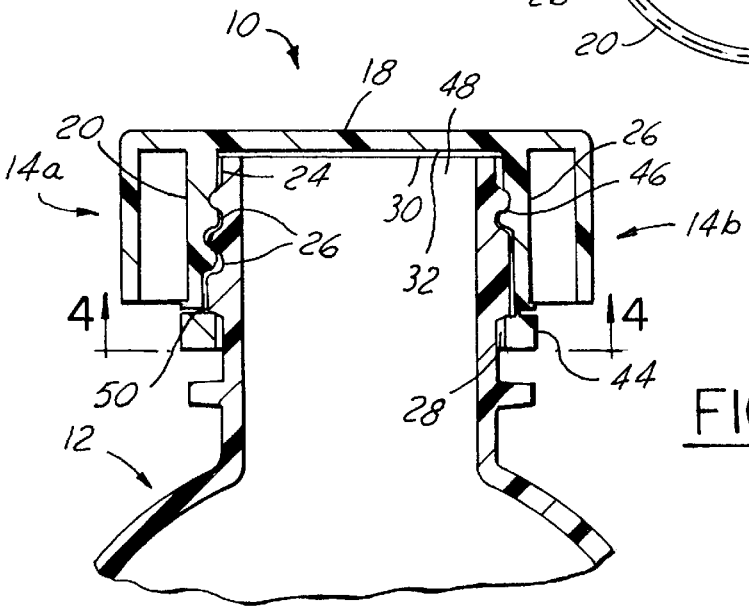
FIG. 3 is a sectional view taken along line 3—3 of FIG. 2.

As shown at FIGS. 3 and 4, the tabs 14*a,* 14*b* need not be solid, indeed, it is preferred for the tabs to be hollow in order to conserve material and reduce weight, while yet providing sufficient stiffness that a user who presses thereupon at the fingerhold F would not cause the tabs to collapse or otherwise untowardly distort even where the tabbed cap is very tightly threaded onto the container 12.

As indicated hereinabove, the tabs 14*a,* 14*b* are structured to provide unidirectional assistance to a user, to thereby render grip assistance to unthread the tabbed cap 10 from a container 12, but not render assistance to thread it back onto the container. To this end, each tab 14*a,* 14*b* is asymmetrically shaped, having a forward face 34 which is generally radial with respect to the circumference of the annular sidewall 20, and a rearward face 36 which is generally tangential to the annular sidewall. The asymmetry makes it readily apparent to a user which way to turn the tabbed cap to unthread it from the container, and further ensures the user cannot use the tabs 14*a,* 14*b* to over tighten the tabbed cap back onto the container.

The forward face 34 of the tabs 14*a,* 14*b* provides the aforesaid fingerhold F. In this regard, it is preferred for the forward face 34 to be concavely shaped. More particularly, it is further preferred for the forward interface 38 of the tabs 14*a,* 14*b* with the annular sidewall 20 to be forward of the apex 40 thereof.

The rearward face 36 is preferred to be generally straight between the rearward interface 42 of the tabs 14*a,* 14*b* with the annular sidewall 20 and the apex 40. In this regard, the rearward face 36 is tangent to the curvature of the annular sidewall 20 at the rearward interface 42.

As generally indicated at FIG. 3, a gasket 30 is preferably provided by conventional insertion and retention at the interior side 32 of the top wall 18. Further, a conventional breakable ring 44 is preferably conventionally connected with the annular sidewall 20 at the cap opening 28. It is still further preferred to include conventional longitudinal knurling on the annular sidewall 20, where conventionally appropriate.

Operation of the tabbed cap 10 will now be detailed.

As shown at FIG. 3, the container 12 has threads 46 adjacent the container opening 48 upon which the tabbed cap 10 is threaded. The breakable ring 44 is conventionally trapped on the container by a annular flange 50. The combination of tight threading, carbonation pressure, and/or the need to break the breakable ring in order to unscrew the tabbed cap renders the need for a large torque to be supplied thereto by the user, yet the small diameter of the tabbed cap makes this difficult to achieve.

However, because of the tabs 14*a,* 14*b,* the user is easily able to unscrew the tabbed cap by pressably engaging his or her finger(s) and thumb against the forward face in the unthreading direction tangential to the annular sidewall to unscrew the tabbed cap from a threaded container 12.

While the user may rethread the tabbed cap back onto the threads of the container, the rearward face 36 does not provide an abutment for a user to pressably rotate the tabbed cap in the threading direction. Accordingly, the tabs do not assist a person to thread the cap back onto the container, and the tabs do not contribute to accidental over tightening of the cap onto the container.

By way of example, for a beverage cap having a diameter of about 1.25 inches, each of the tabs may be about 5/32 of an inch as measured radially between the annular sidewall and the apex.

Alternative to the preferred embodiment shown and described, the rearward face of each tab may be spirally formed. For example, the spiral may smoothly increase to the apex having a rearward interface substantially at the forward interface of the other of the tabs.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A tabbed cap and threaded container, comprising:

a container having threads adjacent an opening thereof; and a tabbed plastic cap threadably engageable with said threads, said tabbed cap comprising:

a top wall;

an annular sidewall integrally connected with said top wall, said annular sidewall having an exterior side and an interior side and an opening opposite said top wall, said interior side having thread means formed thereat for threadably engaging threads of said container inserted through said opening; and a pair of tabs integrally formed with said annular sidewall, said pair of tabs comprising:

a first tab located at a first location of said exterior side; and a second tab located at a second location of said exterior side diametrically opposite said first location;

wherein said first and second tabs each comprise:

a forward face;

a rearward face intersecting said annular sidewall, said rearward face being substantially tangential with respect to said annular sidewall at said intersection; and an apex at an intersection of said forward and rearward faces;

wherein said first and second tabs are asymmetrically shaped wherein said forward face has a concavely shaped fingerhold which provides an abutment for pressably rotating said tabbed cap in an unthreading direction of said thread means and wherein said rearward face is substantially free of abutment to assist pressably rotating said tabbed cap in a threading direction of said thread means;

wherein said first and second tabs extend along said annular sidewall substantially from said top wall to said opening; and wherein said concavely shaped fingerhold of said first and second tabs extends substantially from said top wall to said opening.

2. The tabbed cap and threaded container of claim 1, wherein said container is a plastic beverage container.

* * * * *